US006468624B1

(12) United States Patent
Fujisawa et al.

(10) Patent No.: US 6,468,624 B1
(45) Date of Patent: Oct. 22, 2002

(54) FASTENER STRIP WITH MAGNETIC ATTRACTANT

(75) Inventors: Nobuo Fujisawa, Macon, GA (US); Craig Jay Graham, Eastman, GA (US); Tsuyoshi Minato Minato, Macon, GA (US); John Alexander Galbreath, Reisterstown, MD (US)

(73) Assignee: YKK Corporation of America, Marietta, GA (US)

( * ) Notice: Subject to any disclaimer, the term of this patent is extended or adjusted under 35 U.S.C. 154(b) by 71 days.

(21) Appl. No.: 09/716,004

(22) Filed: Nov. 20, 2000

(51) Int. Cl.[7] ..... A44B 21/00

(52) U.S. Cl. ..... 428/100; 428/99; 428/900; 24/442

(58) Field of Search ..... 428/99, 100, 120, 428/900; 24/306, 442, 445, 451, 452, 446, 450, 447

(56) References Cited

U.S. PATENT DOCUMENTS

| | | | | |
|---|---|---|---|---|
| 4,563,380 A | | 1/1986 | Black et al. | |
| 4,673,542 A | | 6/1987 | Wigner et al. | |
| 4,931,344 A | | 6/1990 | Ogawa et al. | |
| 5,061,540 A | | 10/1991 | Cripps et al. | |
| 5,110,649 A | | 5/1992 | Morse et al. | |
| 5,500,268 A | | 3/1996 | Billerant | |
| 5,725,928 A | | 3/1998 | Kenney et al. | |
| 5,786,061 A | * | 7/1998 | Banfield | 428/100 |
| 5,945,193 A | | 8/1999 | Pollard et al. | |
| 6,112,377 A | * | 9/2000 | Wilson | 24/452 |

OTHER PUBLICATIONS

US 5,393,585, 2/1995, Banfield et al. (withdrawn)

* cited by examiner

*Primary Examiner*—Alexander S. Thomas
(74) *Attorney, Agent, or Firm*—John A. Galbreath

(57) ABSTRACT

The invention is a hook fastener strip (10), having magnetically attractable wires (13*a,b,c,&d*) which are located between, and retained by, hook members (11) on the front face of the fastener strip (10). Each hook member (11) is comprised of a shaft (14) and a split-mushroom-shaped head (15). The outer edges of head (15) protrude beyond the sides of shaft (14), and the undersides of the outer edges form ledges (16*a&b*) which serve to retain the magnetically attractable wires (13*a,b,c,&d*) within the hook layer of the fastener strip (10). The magnetically attractable wires (13*a, b,c,&d*) within the fastener strip allow it to be secured to a correspondingly magnetically attractive object.

24 Claims, 11 Drawing Sheets

FASTENER STRIP WITH MAGNETIC ATTRACTANT

CROSS-REFERENCES TO RELATED APPLICATIONS

Not applicable.

BACKGROUND

1. Field of the Invention

This invention is in the area of hook-and-loop fastener strips, specifically a hook fastener strip with magnetically attractable elements which are located between, and retained by, the hooks on the engagement side of the fastener strip.

2. Description of the Related Art

Various fastener strips which can be magnetically secured to an object, usually a forming mold, are disclosed in the art. The magnetically attractive components of these fastener strips include:

Magnetic particles incorporated either between the fastener backing and the anchor layer, as in U.S. Pat. No. 4,563,380 to Black et al.; in an "encasement" which protects the hooks from fouling, as in U.S. Pat. No. 5,393,585 to Banfield et al.; or mixed into the plastic of the hooks or hook base, as in U.S. Pat. No. 5,725,928 to Kenney et al.

A magnetic strip or shim interposed either between the fastener layer and the fastener backing, as in U.S. Pat. No. 4,673,542 to Wigner et al.; between the fastener backing and an open-mesh layer, as in U.S. Pat. No. 5,110,649 to Morse et al.; incorporated within the fastener backing, as in U.S. Pat. No. 5,061,540 to Cripps et al.; or located along the sides of the hook layer, as in U.S. Pat. No. 4,931,344 to Ogawa et al.

A "porous metal layer", either embedded in the fastener layer or backing, or inserted between the hooks and a protective cover, as in U.S. Pat. No. 5,945,193 to Pollard et al.

Metal staples located at each end of the fastener strip, as in U.S. Pat. No. 5,500,268 to Billerant.

All of the above methods, however, have a major disadvantage in that the magnetic element has to be embedded into, molded into, or otherwise incorporated into the body of the fastener strip itself. This results in a needlessly complex manufacturing process, often requiring the use of adhesives to secure the magnetic element to the fastener layer, the backing, protective hook cover, or other fastener strip component. In addition, in these fastener strips, the magnetic element must be incorporated during the basic strip assembly/fabrication process, since the magnetic element is an integral part of the fastener strip itself.

The magnetic element cannot be easily applied to the fastener strip after the strip has been assembled.

Accordingly, several objects and advantages of the invention are:

The invention provides a quick and easy way to incorporate a magnetic element into a fastener strip. No adhesives are needed, because the specially-shaped hooks themselves hold the magnetically attractable wires or strips in place.

The resultant fastener strip of the invention can be very effectively secured to a correspondingly magnetically attractable object, such as a forming mold. The magnetic elements can be easily placed anywhere on the face of the fastener strip for maximum magnetic holding power.

The magnetically attractable wires or strips can be put on during or after the basic strip assembly/fabrication process, which adds flexibility to the manufacturing process.

Further objects and advantages of the invention will become apparent from a consideration of the drawings and ensuing description.

SUMMARY

The invention is a hook fastener strip with magnetically attractable elements which are interposed between, and retained by, the hooks on the front side of the fastener strip. The magnetically attractable elements allow the fastener strip be secured to the magnetized recess of a forming mold, or to any corresponding magnetically attractive object.

DETAILED DESCRIPTION OF THE INVENTION

Figure 1:
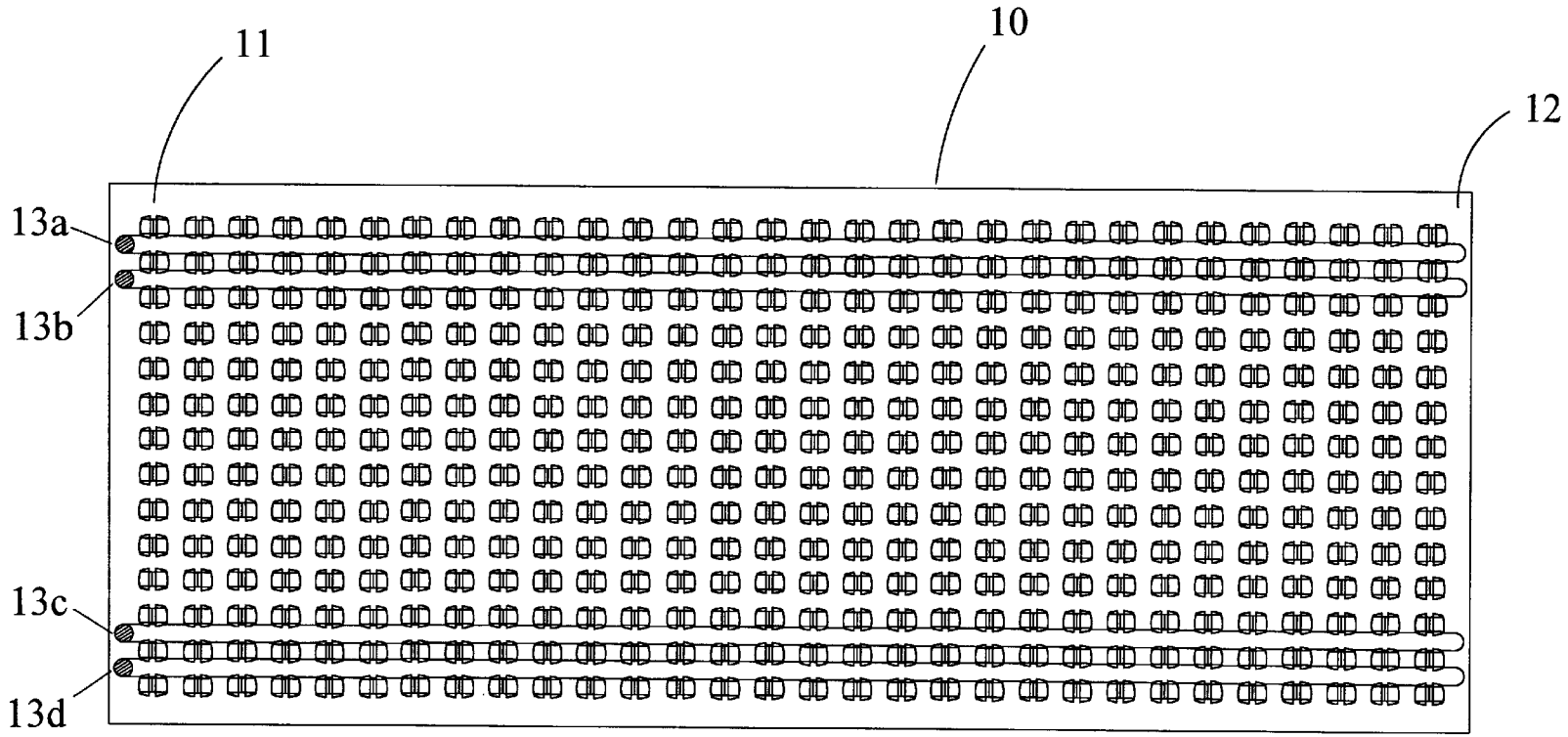
FIG. 1 is an overall top view of the invention, showing the magnetically attractable wires located between the hooks of the fastener strip.

The following provides a list of the reference characters used in the drawings:

10. Fastener strip
11. Hook member
12. Base
13*a,b,c,&d.* Magnetically attractable wires
14. Shaft
15. Head
16*a&b.* Ledges
17*a,b,c,&d* Magnetically attractable strips (alternative embodiment)
18. Wide magnetically attractable strip (alternative embodiment)
19*a,b,&c.* Runners (alternative embodiment)
20. Connecting member (alternative embodiment)
21. Magnetically attractable chain (alternative embodiment)

FIG. 1 provides an overall top view of the invention. An elongated fastener strip 10 has a plurality of hook members 11 upstanding from a base 12. Hook members 11 can either be molded from the same material as base 12, or can be formed separately and attached to base 12. Elongated magnetically attractable wires 13*a,b,c,&d,* circular in cross-section, are located between hook members 11, and are retained by the undersides of the outer edges of hook members 11.

Figure 2:
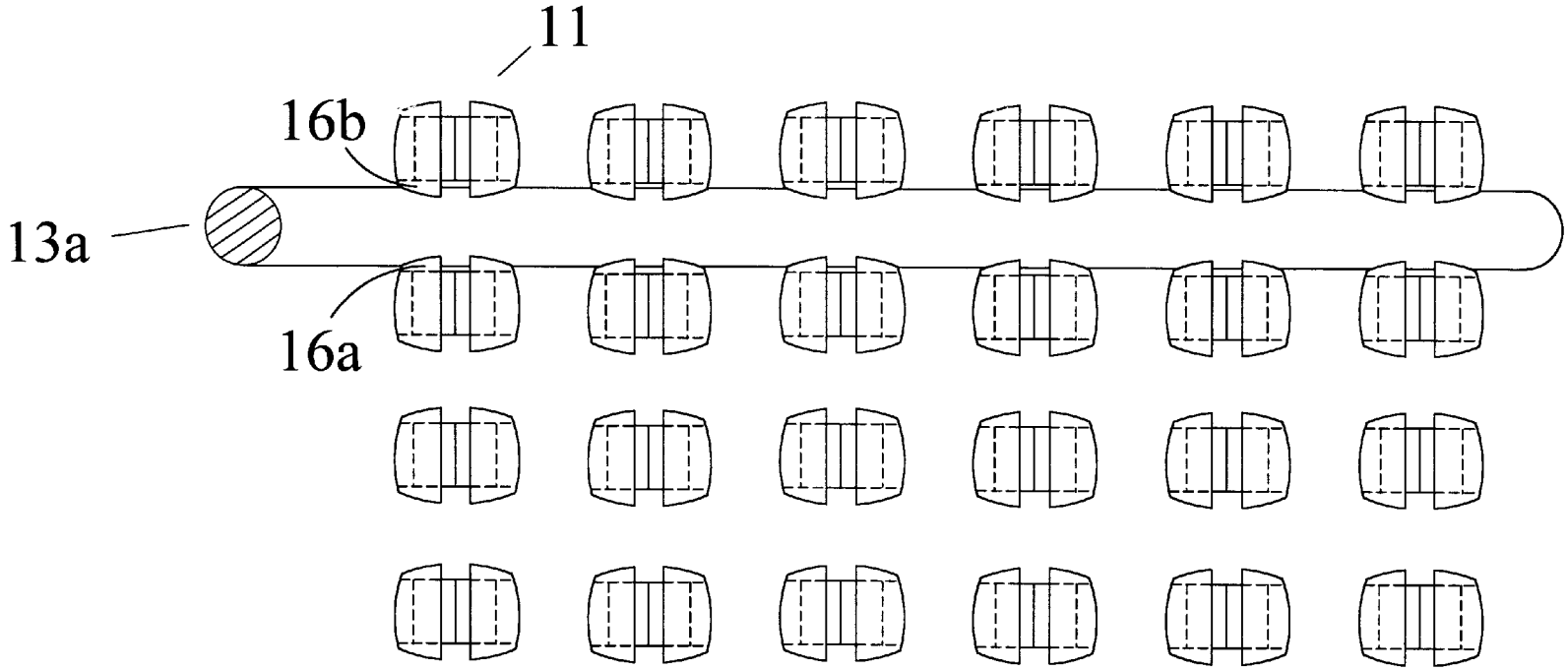
FIG. 2 is a more-detailed top view, which illustrates the manner in which the wires are retained by the undersides of the hooks.
Figure 3:
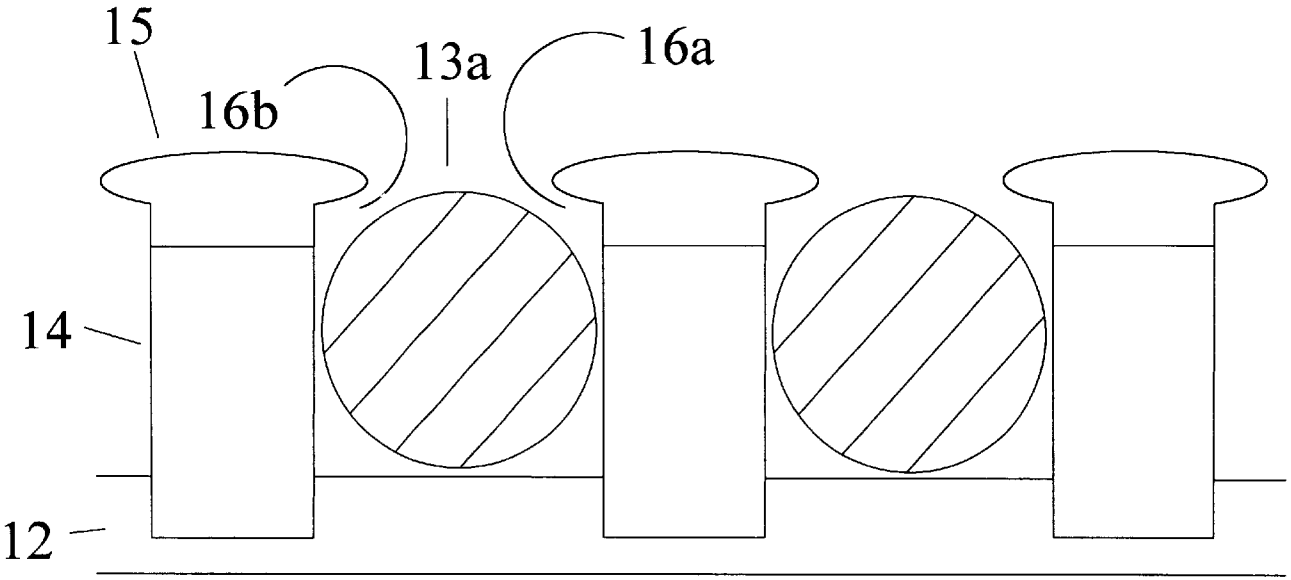
FIG. 3 is an end view, further illustrating the location and positioning of the wires within the hook layer of the fastener strip.

FIGS. 2 and 3 provide detailed views of fastener strip 10, which illustrate the manner in which the undersides of the outer edges of hook members 11 retain magnetically attractable wires 13*a,b,c,&d.* Turning now to the structure of hook members 11, each hook member 11 is comprised of a shaft 14 and a split-mushroom-shaped head 15. The outer edges of head 15 protrude beyond the sides of shaft 14, such that the undersides of the outer edges of head 15 form ledges 16 *a&b.* Ledges 16*a&b* serve to retain magnetically attractable wires 13*a,b,c,&d* within fastener strip 10. By way of further illustration, an example of such a hook structure is the D-7 model molded hook produced by the YKK Corporation of Marietta, Ga.

It is appropriate here to briefly describe the assembly of fastener strip 10. It can be appreciated by one skilled in the art that there are any number of suitable methods by which to insert magnetically attractable wires 13*a,b,c,&d* into the spaces between hook members 11. One such method comprises urging magnetically attractable wires 13*a,b,c,&d* into the space between hook members 11 from the top—i.e., by positioning magnetically attractable wires 13*a,b,c,&d* over the outer edges of adjacent hook members 11 and applying downward pressure. The resilience of hook members 11 allows hook members 11 to spring apart slightly, permitting magnetically attractable wires 13*a,b,c,&d* to pass between the outer edges of adjacent hook members 11. After magnetically attractable wires 13*a,b,c,&d* have passed into the space between hook members 11, hook members 11 spring back, retaining magnetically attractable wires 13*a,b,c,&d* within. In this manner, magnetically attractable wires 13*a, b,c,&d* con be considered to "snap into" fastener strip 10.

Another method which can be envisioned comprises threading magnetically attractable wires 13*a,b,c,&d* into the spaces between hook members 11, starting from the ends of fastener strip 10.

Figure 4:
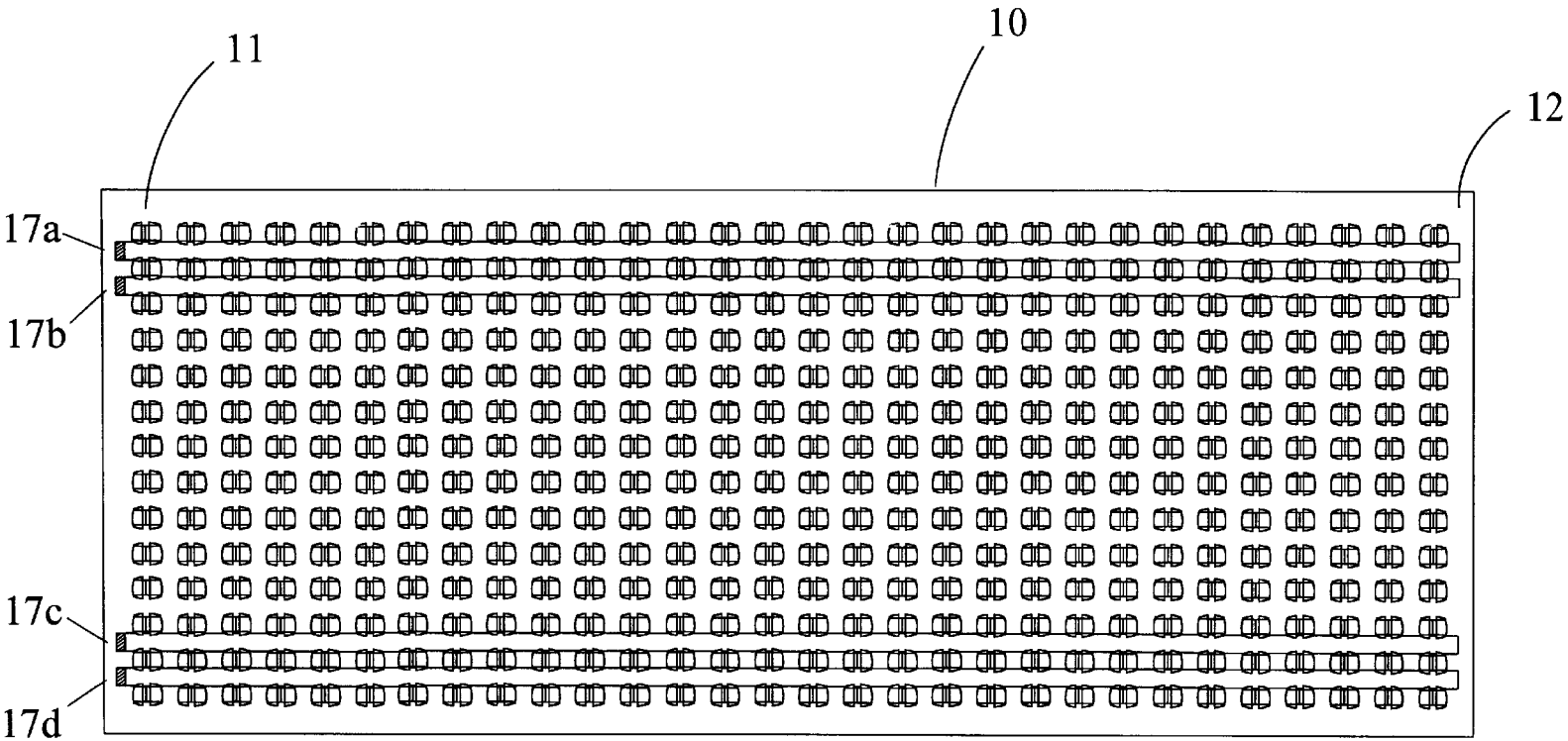
FIG. 4 is a top view of an alternative embodiment, wherein magnetically attractable flat strips are used instead of wires.
Figure 5:
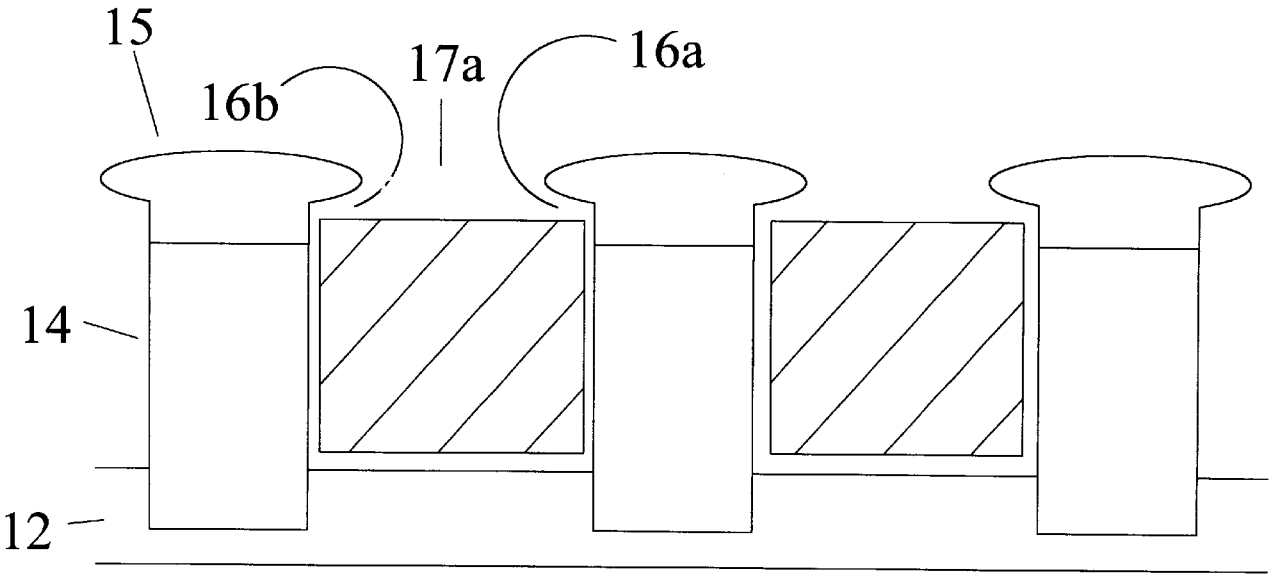
FIG. 5 is an end view of the alternative embodiment of FIG. 4.

FIGS. 4 and 5 illustrate top and end views, respectively, of an alternative embodiment wherein elongated magnetically attractable strips 17*a,b,c,&d* of rectangular cross-section - rather than wires of circular cross-section, as in the main embodiment - are located between hook members 11. Other parts, and other assembly steps, are the same as in the main embodiment.

Figure 6:
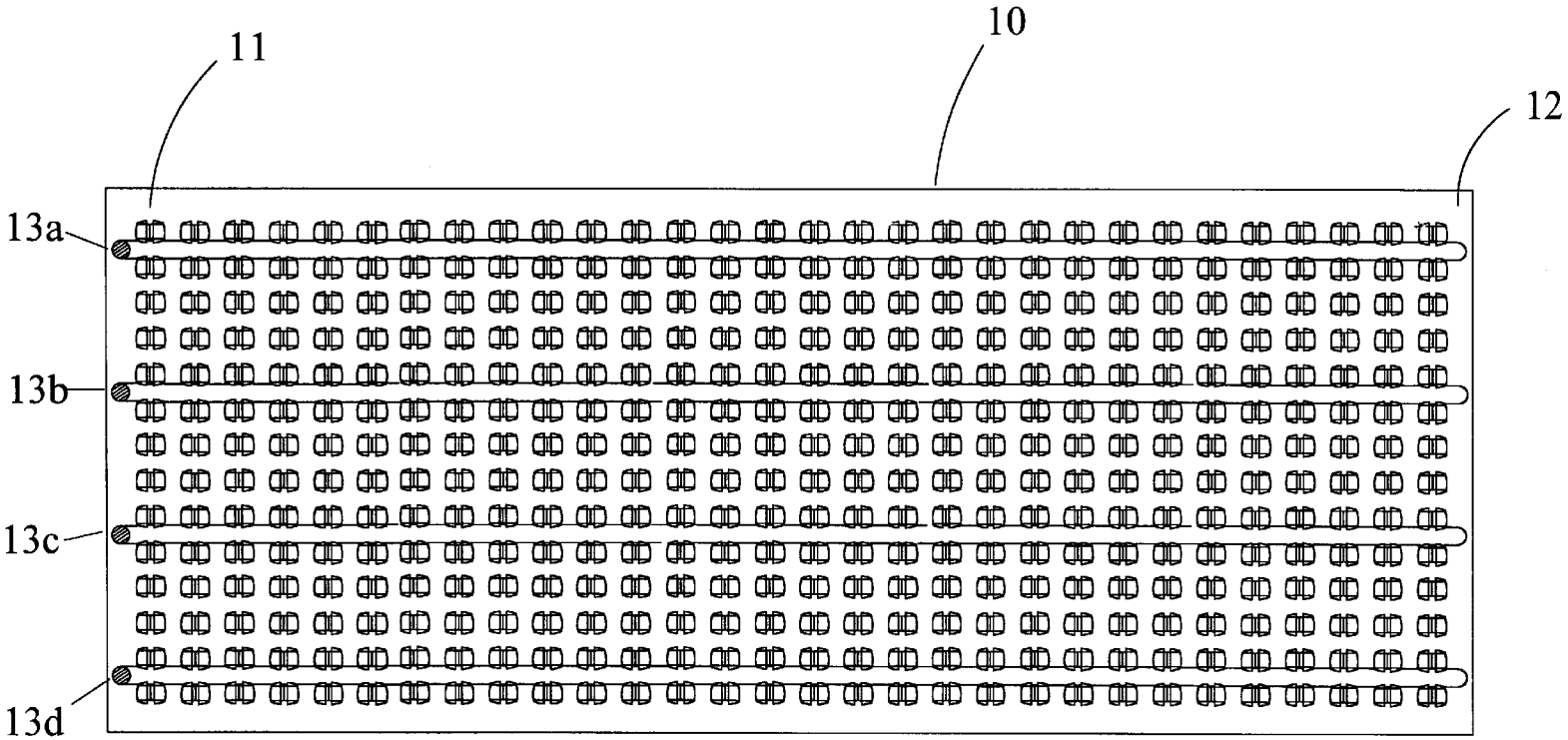
FIG. 6 is a top view of an alternative embodiment, wherein the magnetically attractable wires are distributed differently across the face of the fastener strip.
Figure 7:
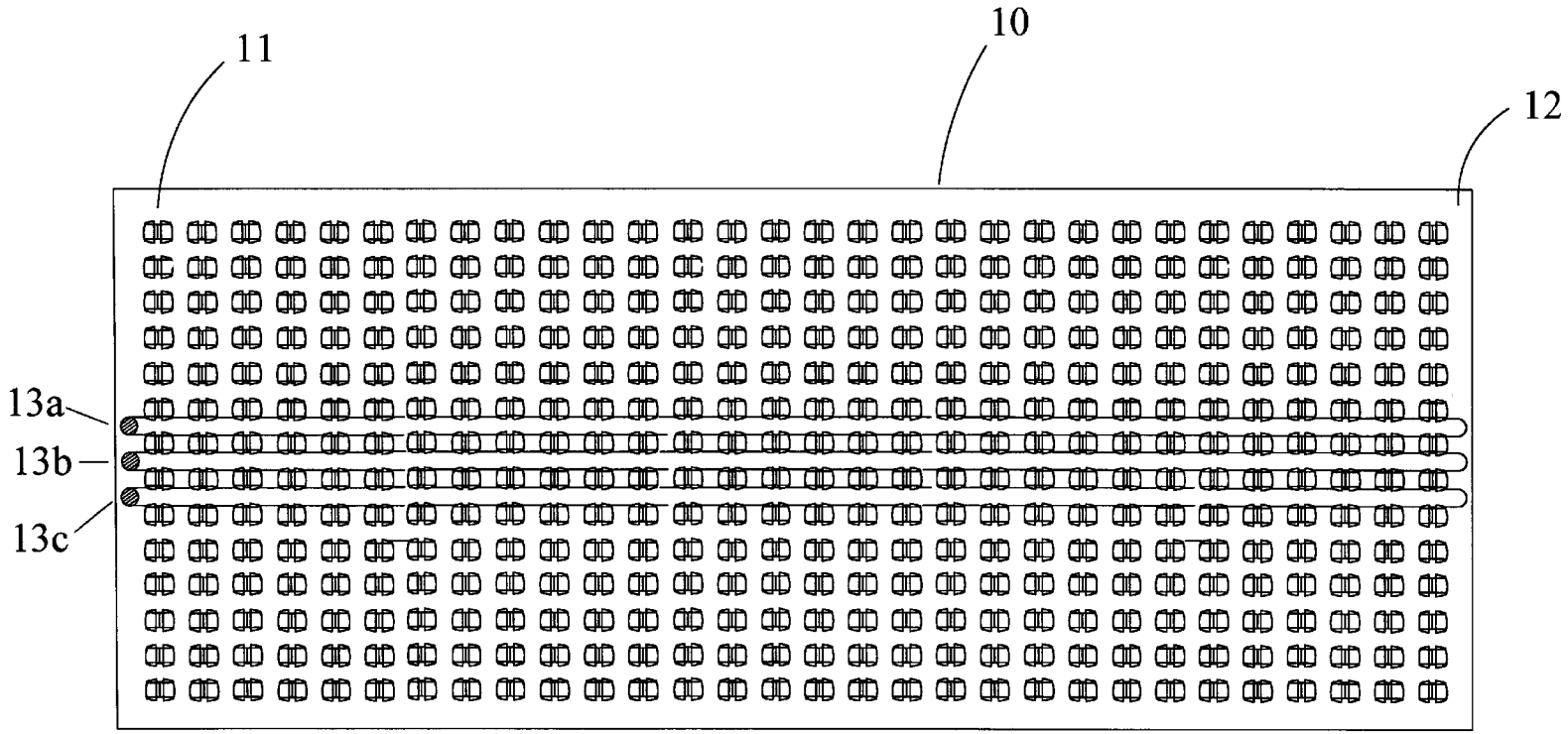
FIG. 7 is a top view of another alternative embodiment, also showing the magnetically attractable wires distributed differently across the face of the fastener strip.

FIGS. 6 and 7 illustrate alternative embodiments wherein magnetically attractable wires 13*a,b,c,&d* are distributed differently across the face of fastener strip 10. In FIG. 6, magnetically attractable wires 13*a,b,c,&d* are distributed more or less evenly across the face of fastener strip 10, rather than being located at the sides of fastener strip 10 as in the main embodiment. In FIG. 7, magnetically attractable wires 13*a,b,&c* are disposed down the center of fastener strip 10. Other parts, and other assembly steps, are the same as in the main embodiment.

Figure 8:
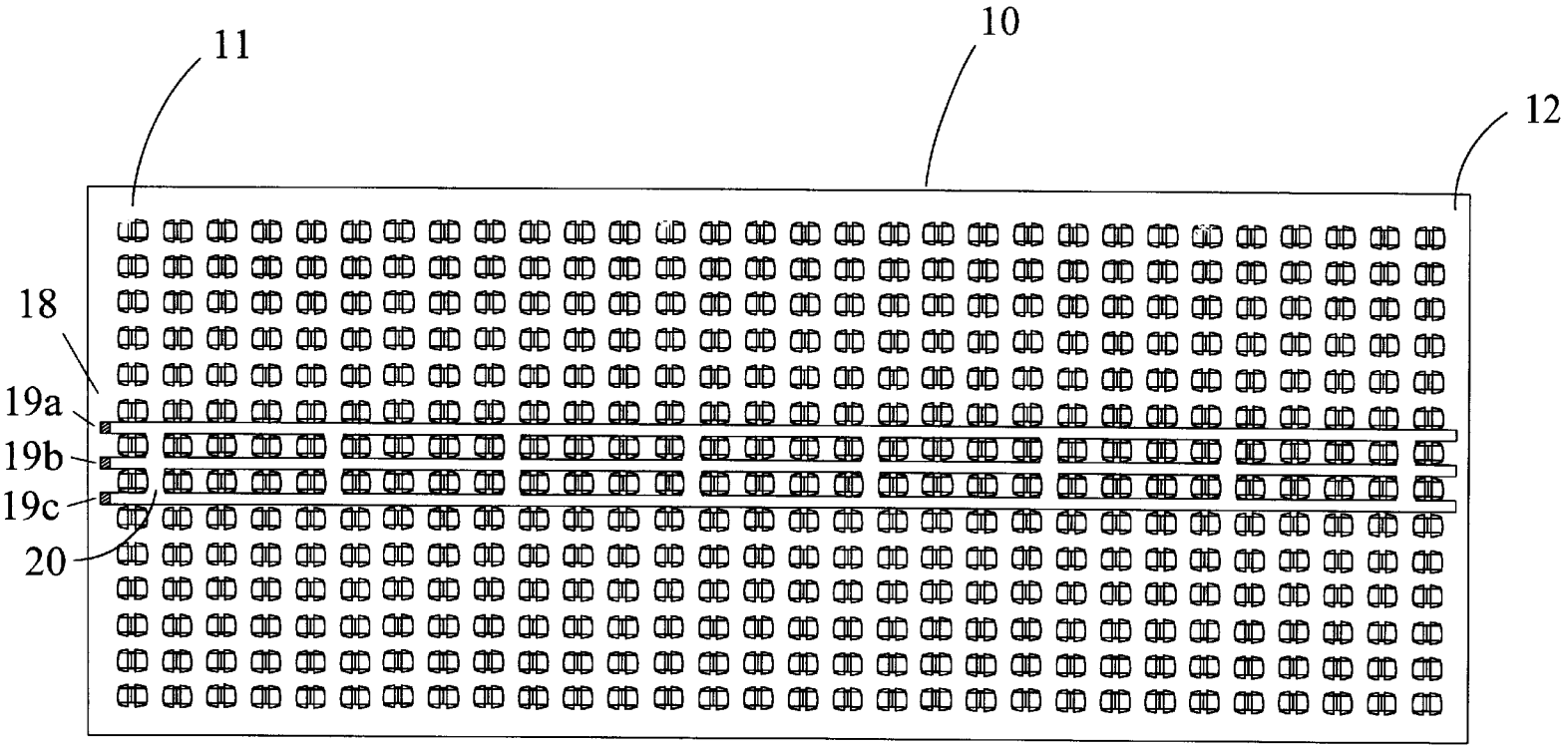
FIGS. 8 and 9 show overall and detail-level views, respectively, of an alternative embodiment, wherein a magnetically attractable strip, of greater width than the strips shown in the FIG. 4 & 5 embodiments, is located between the hooks of the fastener strip.
Figure 9:
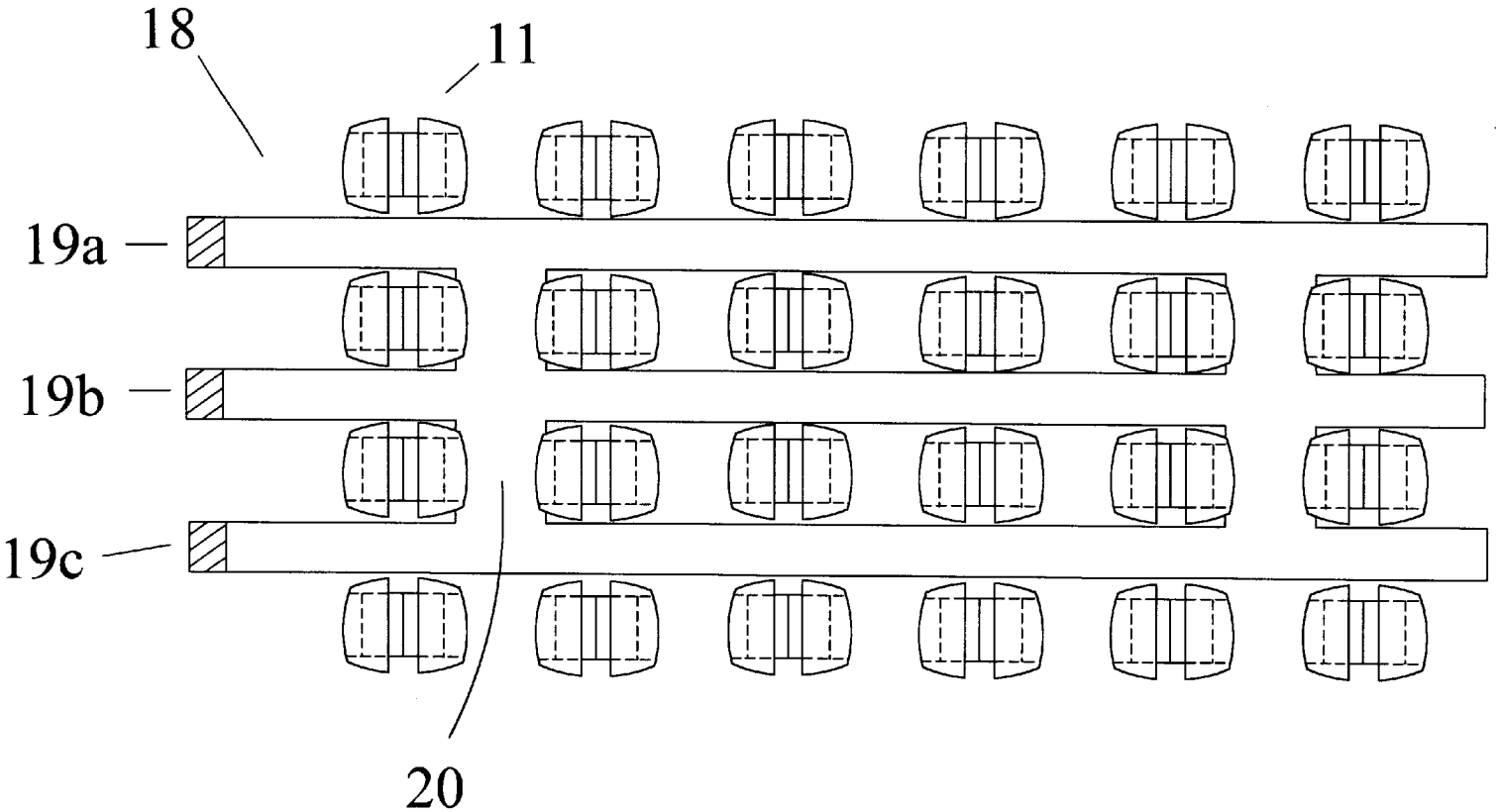

FIGS. 8 and 9 illustrate an alternative embodiment wherein a wide magnetically attractable strip 18 takes the place of multiple magnetically attractable wires or strips. Wide magnetically attractable strip 18 comprises multiple runners 19*a,b,&c,* connected periodically by a connecting member 20. Connecting member 20 snaps into the space between adjacent columns of hooks members 11 —rather than into the space between adjacent rows of hook members 11 as in the main embodiment. This alternative embodiment allows a larger magnetically attractable mass to be snapped into the fastener strip in one step, and avoids having to maintain multiple wires or strips in precise alignment together while attaching them to the fastener strip. Other parts, and other assembly steps, are the same as in the main embodiment.

Figure 10:
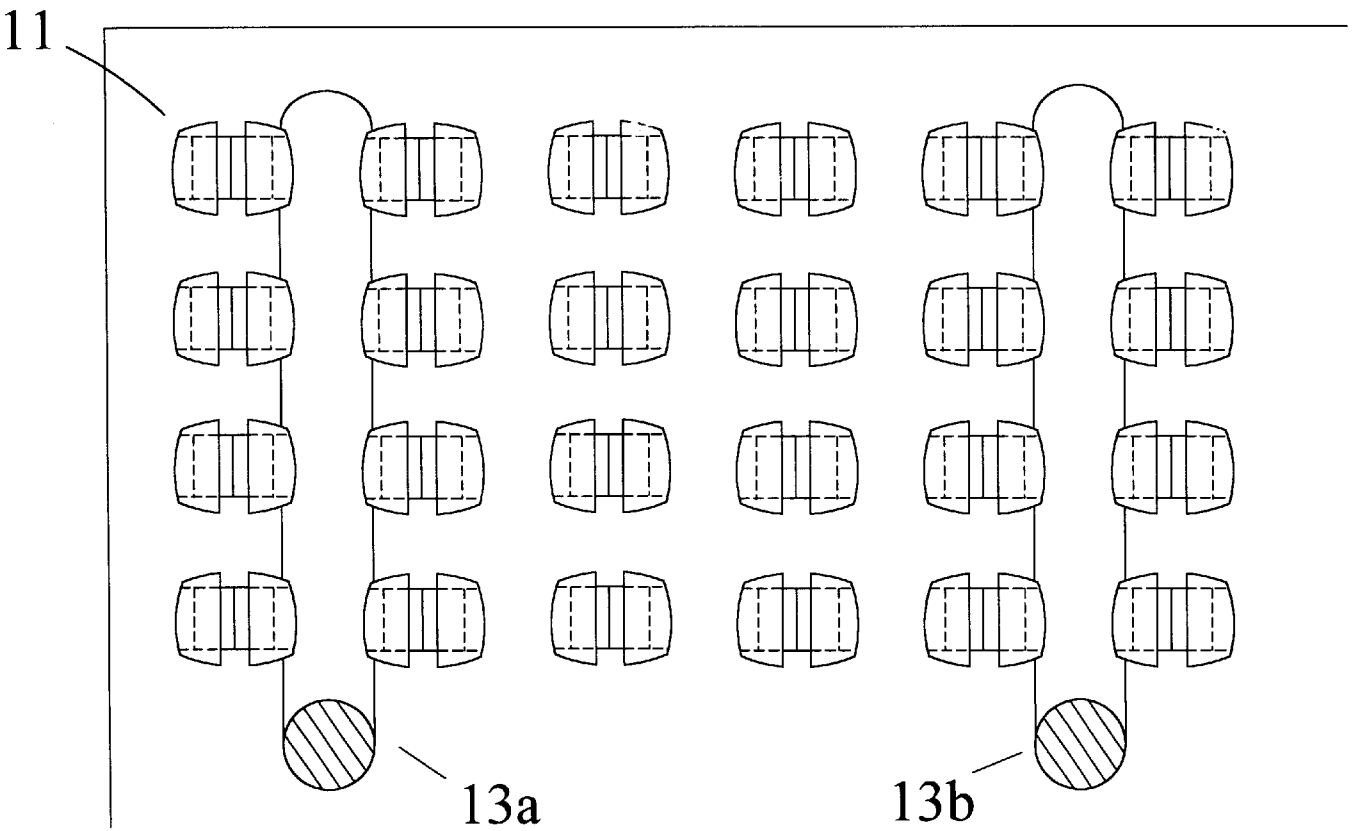
FIG. 10 is a top view of an alternative embodiment wherein a magnetically attractable wire is located transversely—that is, across the width of the fastener strip.

FIG. 10 illustrates an alternative embodiment wherein magnetically attractable wires 13*a&b* are located transversely—i.e., across the width—of fastener strip 10. Magnetically attractable wires 13*a&b* snap into the space between adjacent columns of hook members 11—rather than into the space between adjacent rows of hook members 11 as in the main embodiment. In this alternative embodiment, wherein magnetically attractable wires 13*a&b* do not impart any longitudinal stiffness to fastener strip 10, thus allowing fastener strip 10 to be supplied to customers in a long continuous spool without having an attendant tendency to "curl" from being stored in such a manner. It should be understood, of course, that although FIG. 10 shows just two transversely-located wires, any number of wires can be disposed transversely across the fastener strip, distributed either evenly or in various groupings. Other parts, and other assembly steps, are the same as in the main embodiment.

Figure 11:
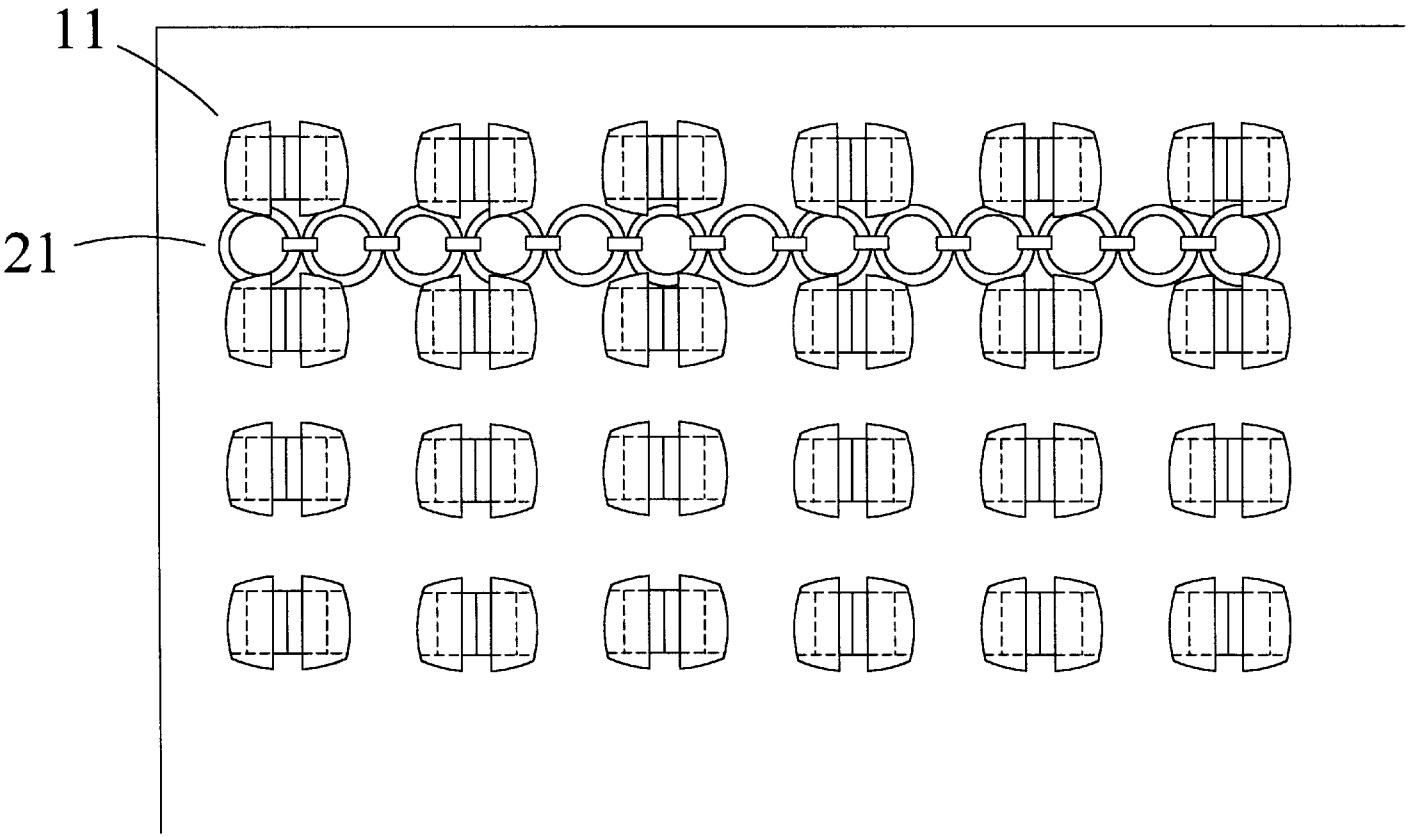
FIG. 11 is a top view of an alternative embodiment wherein a magnetically attractable chain is located along the lengthwise dimension, and between the hooks, of the fastener strip.

FIG. 11 illustrates an alternative embodiment wherein a magnetically attractable chain is located along the lengthwise dimension of fastener strip 10, between hook members 11. Chain 21, being flexible in nature, does not impart significant longitudinal stiffness to fastener strip 10, thus allowing fastener strip 10 to be supplied to customers in a long continuous spool without having an attendant tendency to "curl" from being stored in such a manner. It should be understood, of course, that although FIG. 11 shows just chain, any number of chains can be disposed on the fastener strip, distributed either evenly or in various groupings. Other parts, and other assembly steps, are the same as in the main embodiment.

Conclusions, Ramifications, and Scope:

Thus the reader will see that this invention provides a very convenient and effective way of incorporating magnetically attractable elements into a fastener strip, so that the fastener strip may be magnetically secured to a forming mold or other corresponding magnetically attractive object.

While the above descriptions contain many specificities, these shall not be construed as limitations on the scope of the invention, but rather as exemplifications of embodiments thereof. Many other variations are possible. Examples of just a few of the possible variations follow:

The fastener strip can be of any shape, including circular or square-shaped, and not just the rectangular strip shape shown in the various embodiments above. The basic concept of the invention - magnetically attractable elements located between, and retained by, the hooks themselves - is applicable to fastener strips having many different shapes.

The number of magnetically attractable elements can be different, and they can be located differently on the face of the fastener strip than those locations shown in the main and alternative embodiments. The magnetically attractable elements do not have to be elongated—for example, they can be separate and discrete elements of any size and shape. The magnetically attractable element also does not have to be circular or rectangular in cross-section—as just two examples, it can also be triangular or diamond-shaped. All that is required is that the magnetically attractable element be suitably shaped to engage and be retained by the hooks.

The alternative embodiment shown in FIG. 11 can have the links of the chain snapped into place over the hook heads, rather than between the hook heads as shown. Said another way, each link of the chain can "surround" a hook head or multiple hook heads.

An embodiment can also be envisioned wherein a wire mesh comprised of intersecting vertical and horizontal elements, is snapped into place between the hooks.

The transverse wire positioning shown in the embodiment of FIG. 10 - that is, the wire positioned across the width of the fastener strip - can be used with magnetically attractable elements of many different natures and cross-sectional shapes. As just two examples, flat strips having a rectangular cross section, or "wide strips" similar to that shown in the embodiment of FIGS. 8 and 9, can be positioned transversely between the hooks.

The magnetically attractable element can be snapped between the hooks in a "staggered diagonal" fashion—that is, first between two rows of hooks, then between two columns of hooks, then between two rows of hooks, and so on—such that the magnetically attractable element runs an essentially diagonal course across the face of the fastener strip.

The "head" of the hook can have a different shape, as long as an aspect of its shape can serve to retain a wire, strip, or other magnetically attractable element. As just one example, the underside of the head can have a different shape—not just the "rounded ledge" shape of the main embodiment. Similarly, the cross-sectional shape of the magnetically attractable elements can be different—not just the cylindrical wires and flat rectangular strips shown in the main and alternative embodiments. All that is required is that a surface on the hooks be suitably shaped to retain the magnetically attractable elements, and that the magnetically attractable elements themselves be correspondingly shaped to be retained by the hooks.

The magnetically attractive elements can be additionally retained within the hook fastener layer through the use of various adhesives, or by embedding the magnetically attractive elements onto the hook fastener layer.

Not all the hooks on the face of the fastener strip need have a structure that can retain a magnetically attractable element. Only those hooks in the area where the magnetically attractable element is to be located need have such a structure.

A one-piece, "perimeter" version of the wide magnetically attractable strip embodiment can be envisioned, which snaps into, and forms a border around, the hook layer perimeter (the sides and ends). A wide magnetically attractable strip version can also be envisioned, having slots or other openings (round, oblong, rectangular, etc.) which are slightly smaller than the hook heads. The natural resiliency of the hook heads allows them to deform slightly as the wide magnetically attractable strip is urged downward over them. In this manner the wide magnetically attractable strip snaps into place over the hooks.

The magnetically attractable element can comprise various metals or other magnetically attractable materials; in addition, it should be understood that the magnetically attractable element can itself be magnetically attractive—that is, itself be a magnet. This would allow the fastener strip to be secured to metal or other magnetically attractable objects which are not magnets themselves.

Accordingly, the scope of the invention should be determined not by the embodiments illustrated, but by the appended claims and their legal equivalents.

What is claimed is:

1. A hook fastening device, comprising:

(a) a hook fastener layer, having a plurality of hook members upstanding from a base, said hook members having engagement surfaces located on their undersides, and (b) a magnetically attractable element located between, and retained by, said hook members of said fastener layer, said magnetically attractable element not extending above the height of said engagement surfaces on said undersides of said hook members, whereby said hook fastening device can be magnetically secured to an object.

2. The device of claim 1, wherein said hook members each comprise a shaft and mushroom-shaped head.

3. The device of claim 2, wherein said magnetically attractable element is retained by projecting ledges located on the undersides of said hook members.

4. The device of claim 1, wherein said magnetically attractable element comprises an elongated wire.

5. The device of claim 1, wherein said magnetically attractable element comprises an elongated strip.

6. The device of claim 1, wherein said magnetically attractable element comprises a chain.

7. The device of claim 1, wherein said magnetically attractable element comprises an elongated strip having a plurality of runners attached together by a connecting element.

8. The device of claim 1, wherein said hook fastening device comprises an elongated fastening strip, and a plurality of said magnetically attractable elements are located between said hook elements at opposite edges along the lengthwise dimension of said elongated fastening strip.

9. The device of claim 1, wherein said hook fastening device comprises an elongated fastening strip, and a plurality of said magnetically attractable elements are substantially evenly distributed over the extent of said elongated fastening strip.

10. The device of claim 1, wherein said hook fastening device comprises an elongated fastening strip, and a plurality of said magnetically attractable elements are disposed substantially down the center of the lengthwise dimension of said elongated fastening strip.

11. The device of claim 1, wherein said hook fastening device comprises an elongated fastening strip, and a plurality of said magnetically attractable elements are transversely located across the width of said elongated fastening strip, between said hook elements.

12. A hook fastening device, comprising:

(a) a hook fastener layer, having a plurality of hook members upstanding from a base, said hook members having engagement surfaces located on their undersides, and (b) a magnetically attractable element located between said hook members of said fastener layer, said magnetically attractable element not extending above the height of said engagement surfaces on said undersides of said hook members, and (c) means for retaining said magnetically attractable element within said hook fastener layer, said means located on said hook members, whereby said hook fastening device can be magnetically secured to an object.

13. The device of claim 12, wherein said hook members each comprise a shaft and mushroom-shaped head.

14. The device of claim 13, wherein said retaining means comprise projecting ledges located on the undersides of said hook members.

15. The device of claim 12, wherein said magnetically attractable element comprises an elongated wire.

16. The device of claim 12, wherein said magnetically attractable element comprises an elongated strip.

17. The device of claim 12, wherein said magnetically attractable element comprises a chain.

18. The device of claim 12, wherein said magnetically attractable element comprises an elongated strip having a plurality of runners attached together by a connecting element.

19. The device of claim 12, wherein said hook fastening device comprises an elongated fastening strip, and a plurality of said magnetically attractable elements are located between said hook elements at opposite edges along the lengthwise dimension of said elongated fastening strip.

20. The device of claim 12, wherein said hook fastening device comprises an elongated fastening strip, and a plurality of said magnetically attractable elements are substantially evenly distributed over the extent of said elongated fastening strip.

21. The device of claim 12, wherein said hook fastening device comprises an elongated fastening strip, and a plurality of said magnetically attractable elements are disposed substantially down the center of the lengthwise dimension of said elongated fastening strip.

22. The device of claim 12, wherein said hook fastening device comprises an elongated fastening strip, and a plurality of said magnetically attractable elements are transversely located across the width of said elongated fastening strip, between said hook elements.

23. A hook fastening device, comprising:

(a) a hook fastener layer, having a plurality of hook members upstanding from a base, and (b) a magnetically attractable elongated wire located between, and retained by, said hook members of said fastener layer, whereby said hook fastening device can be magnetically secured to an object.

24. A hook fastening device, comprising:

(a) a hook fastener layer, having a plurality of hook members upstanding from a base, and (b) a magnetically attractable elongated wire located between said hook members of said fastener layer, and (c) means for retaining said magnetically attractable elongated wire within said hook fastener layer, said means located on said hook members, whereby said hook fastening device can be magnetically secured to an object.

* * * * *